US005857265A

United States Patent [19]

Etiembre et al.

[11] Patent Number: 5,857,265

[45] Date of Patent: Jan. 12, 1999

[54] PROCESS FOR PRODUCING OF A MODULAR ELECTRICAL CONNECTION ELEMENT AND MODULAR ELECTRICAL CONNECTION ELEMENT THUS OBTAINED

[75] Inventors: Dominique Etiembre, Spay; Jacky Thenaisie, Le Mans, both of France

[73] Assignee: Framatome Connectors International, Courbevoie, France

[21] Appl. No.: 632,632

[22] Filed: Apr. 15, 1996

[30] Foreign Application Priority Data

Apr. 21, 1995 [FR] France ..... 95 04803

[51] Int. Cl.[6] ..... H01R 43/00

[52] U.S. Cl. ..... 29/884; 29/845

[58] Field of Search ..... 29/881, 884, 876, 29/882, 845; 439/54.1, 79, 701

[56] References Cited

U.S. PATENT DOCUMENTS

| | | | |
|---|---|---|---|
| 5,037,330 | 8/1991 | Fulponi et al. | 439/607 |
| 5,055,069 | 10/1991 | Townsend et al. | 439/608 |
| 5,104,341 | 4/1992 | Gilissen et al. | 439/608 |
| 5,135,405 | 8/1992 | Fusselman et al. | 439/108 |
| 5,277,624 | 1/1994 | Champion et al. | 439/607 |
| 5,356,301 | 10/1994 | Champion et al. | 439/108 |
| 5,507,655 | 4/1996 | Goerlich | 439/108 |
| 5,577,935 | 11/1996 | Harting et al. | 439/581 |
| 5,607,326 | 3/1997 | McNamara et al. | 439/608 |
| 5,639,267 | 6/1997 | Loudermilk | 439/701 |
| 5,672,064 | 9/1997 | Provencher et al. | 439/79 |

FOREIGN PATENT DOCUMENTS

| | | |
|---|---|---|
| 0549461 A1 | 6/1993 | European Pat. Off. . |
| WO 94/14306 | 6/1994 | WIPO . |

*Primary Examiner*—Rinaldi I. Rada
*Assistant Examiner*—Kevin G. Vereene
*Attorney, Agent, or Firm*—Perman & Green, LLP

[57] ABSTRACT

The invention concerns a process for producing a modular connection element ($C_0$) from independent elementary connectors ($\mathbf{4}_1$ to $\mathbf{4}_8$), having openings. The shielding elements (5*d*) are made from sheet metal. The surfaces of the overall connection element ($C_0$) thus obtained are covered by shielding elements (5*d*) and elementary connectors ($\mathbf{4}_1$ to $\mathbf{4}_8$) are joined together by pushing of specific zones of shielding elements (50*d* to 52*d*) into the openings. One application of the invention would be connection elements ($C_0$) between printed circuit mother and/or daughter boards.

7 Claims, 5 Drawing Sheets

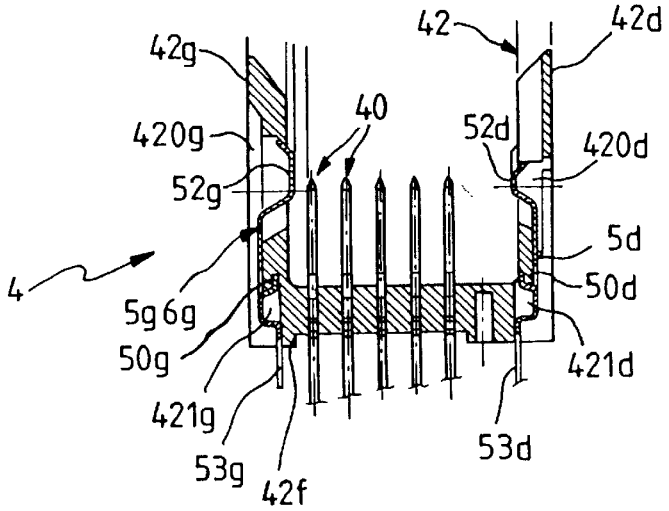
FIG_4
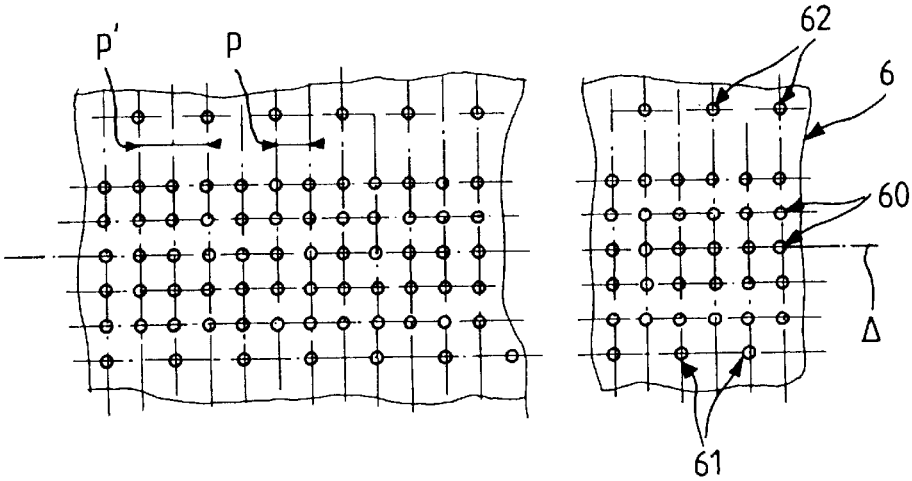
FIG_6
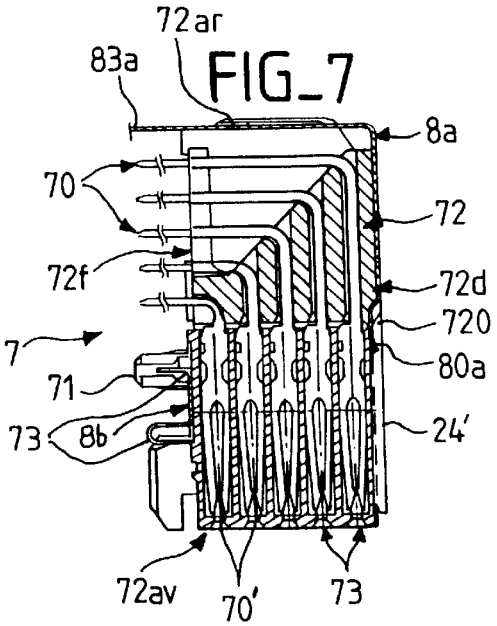
FIG_7
FIG_7a
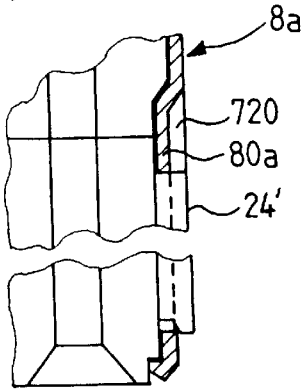

4f
4
4
40
Co
Co
Co
5d
5g
53d
53g
52d
52g
50d
50g
51d
51g

PROCESS FOR PRODUCING OF A MODULAR ELECTRICAL CONNECTION ELEMENT AND MODULAR ELECTRICAL CONNECTION ELEMENT THUS OBTAINED

FIELD OF THE INVENTION

The invention concerns a process for producing a modular electrical connection element, particularly used to make electrical contacts from a mother card and/or a daughter card.

The invention also concerns a modular electrical connection element obtained by the process.

BACKGROUND OF THE INVENTION

Several configurations of modular elements of this type have been proposed, with or without shielding.

By way of nonlimiting example, the following may be cited: French Patents FRA 2,685,554 and FRA 2,685,556, and U. S. Pat. No. 4,451,107.

By way of example and in a more precise manner, the previously mentioned French Patent application FRA 207 2,685,0556 concerns a modular electrical connection element. This element comprises an insulating unit having a central region to receive electrical contact elements and two side branches that are approximately perpendicular to the axis of the central region and have a width that is equal to that of the module. Each side branch has, on an external surface, a shielding element, extending over a major part of its surface. The shielding elements comprise at least one means for maintaining position in the insulating unit, at least one electrical connection means extending beyond the insulating unit, and at least one elastic electrical contact means through at least one corresponding opening of said side branch opening onto an internal surface of said side branch.

SUMMARY OF THE INVENTION

The characteristics intrinsic to devices conforming to this patent application permit eliminating most of the disadvantages presented by previous devices. For this reason, the invention claimed in this application very well fulfills the objectives that it has established. However, when components are produced on a large scale, as is the case of such connection elements, whether for broad public or professional use, a certain number of properties is highly desirable. In particular, the following properties can be cited:

modularity;

facility of manufacture;

and low cost.

This latter parameter also contributes to the greater or lesser degree of complexity of manufacture. All simplification and reduction of production time correlate with cost reduction. The latter also depends on the amount of material used, notably plastics forming the insulating unit of the connectors.

Modularity is possible by devices of the prior art which have just been mentioned. Nevertheless, it is still possible to improve the manufacturing process and thus to lower costs.

The invention, while using the advantages of devices of the prior art, notably modularity, seeks to satisfy the further requirements which are desired, and which have just been mentioned.

To do this, connectors according to the invention are made of several physically independent modules. These modules are connected to one another, at the time of manufacture, by a strip. The strip plays the simultaneous role of attaching the modules to each other and of shielding.

The subject invention is a process for producing a modular electrical connection element, characterized in that it comprises a preliminary phase of creating an elementary connection element, constituting a base module, said elementary connection element comprising an insulating unit of a given shape having a central region designed to receive the electrical contact elements and having slots in specific zones of the outer surface of the insulating unit, and an assembly phase for a predetermined number N of these elementary modules, with N being a whole number greater than or equal to unity, comprising at least the following steps:

production of at least one shielding element from sheet metal, designed to cover said specific zones, each shielding element having a repetitive configuration of elementary length equal to that of said elementary connection element, placement of N elementary connection elements along a given axis, so as to form said connection element, covering of said specific zones by placement of at least one shielding element.

and fastening of these N elementary connection elements by pushing the given zones of each of said shielding elements into said slots.

The subject invention also includes a production process for a modular electrical connection element, characterized in that it comprises a preliminary phase of creating an elementary connection element, constituting a base module, said elementary connection element comprising an insulating unit of a given shape comprising a central region designed to receive electrical contact elements, slides on at least one surface of this unit and slots in specific zones of the outer surface of this insulating unit, and an assembly phase for a predetermined number N of these elementary modules, with N a whole number, greater than or equal to unity, comprising at least the following steps:

production of at least one shielding element from sheet metal, designed to cover said specific zones, each shielding element having a repetitive configuration of elemental length equal to that of said elementary connection element, placement of N elementary connection elements along a given axis so as to form said connection element, covering of said specific zones by placement of at least one shielding element, and fastening of these N elementary connection elements by pushing the specific zones of each of said shielding elements into said slots and fitting of at least one of said shielding elements onto said slides.

The subject invention also includes a modular electrical connection element obtained by this process. The electrical connection element according to the invention has, among other advantages, the advantage of having a very great modularity, both during use and also in manufacture. In fact, for a given type of connector, an entire range can be manufactured from lengths that are multiples of a base length (that of the elementary module) from a single mold. The only difference between the different models of the previously mentioned range is the length of the shielding forming the fastening component. This can be produced continuously and cut to the desired length.

BRIEF DESCRIPTION OF THE DRAWINGS

The invention will be better understood and other characteristics and advantages will appear upon reading the description that follows in reference to the attached figures, among which:

FIG. 4 illustrates, in lateral section, a first example of embodiment of the connector according to the invention;

FIG. 6 illustrates a printed circuit board able to receive this connector;

FIG. 7 illustrates, in lateral section, a second example of embodiment of the connector according to the invention;

DETAILED DESCRIPTION OF THE PRESENT INVENTION

Figure 1:
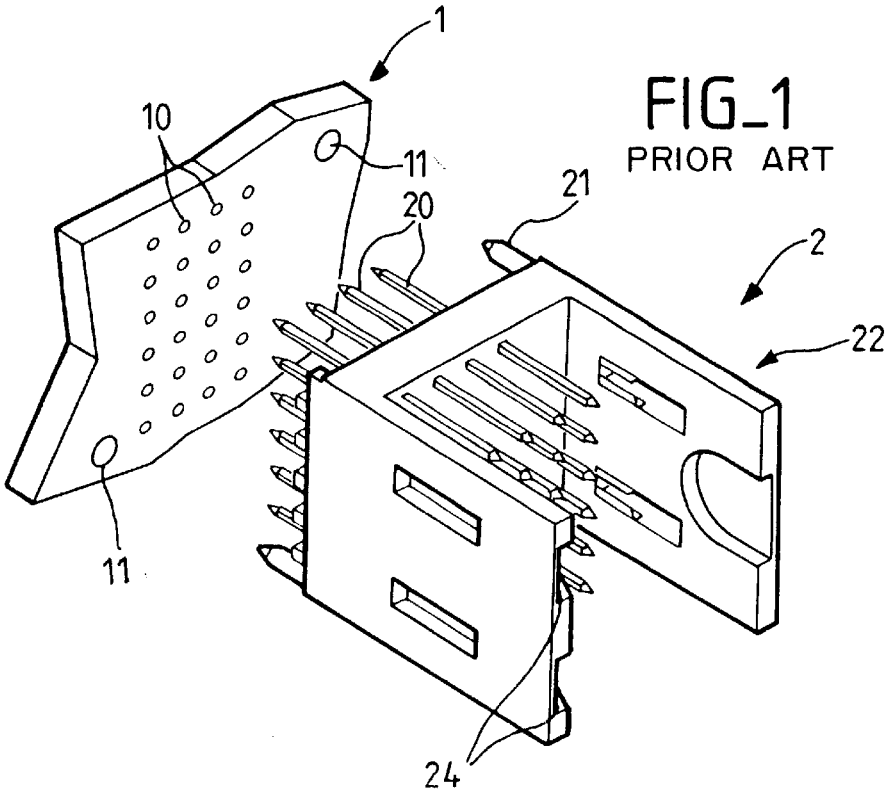
FIG 1 PRIOR ART
FIGS. 1 and 2 illustrate two examples, among the others possible, of connectors according to the prior art, more particularly produced according to the information of the previously mentioned French patent applications.
Figure 2:
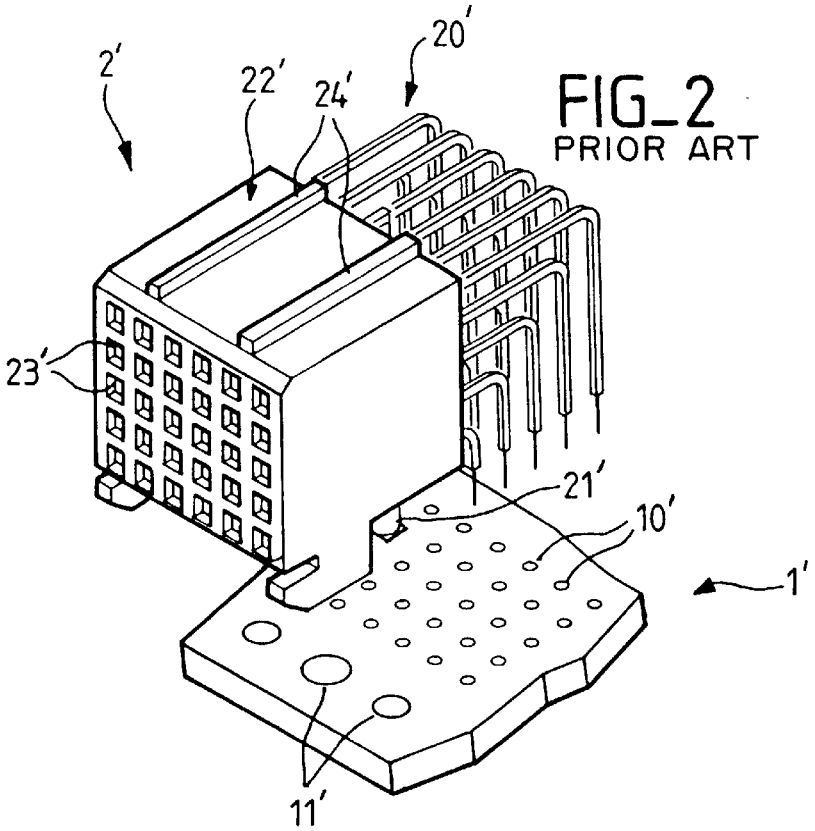
FIG 2 PRIOR ART

We will first briefly describe two examples of connectors according to the prior art, more particularly produced according to the instructions from the previously mentioned French patent applications, in regard to FIGS. 1 and 2. We will only reference, in these figures, the principal elements of these connectors. For a more detailed description, which exceeds the strict scope of this invention, one can readily refer to the descriptions and figures of the French patent applications cited.

FIG. 1 illustrates a connector 2 whose insulating unit 22 has the general shape of a "U", i.e., having a base and two lateral wings. Male contact elements 20, more precisely rectilinear contact elements, are designed to pass through, in the example illustrated, the base. The latter pass through the base of insulating unit 22 of connector 2. They permit insertion of the connector into metal-plated openings 10 of a printed circuit 1, forming a mother or daughter board, depending on the application. The base of insulating unit 22 is usually provided with pins 21, designed to be inserted into openings 11 made in printed circuit board 1.

Connector 2 is soldered by contact elements 20 into metal-plated openings 10. The spacing of these metal-plated openings advantageously conforms to standards or practical norms. This is also the case for the outer dimensions of insulating unit 22 of connector 2.

As has been mentioned, the contact elements pass through the base between the lateral branches. Connector 2 can therefore receive a connection element of the dual type (for example that shown in FIG. 2) that is provided, in the example described, with female contact elements. FIG. 2 illustrates a connector 2' whose main part 22' has a parallelpiped rectangular shape. In the example illustrated, the contact elements are bent on the rear surface to about 90°. They also pass through insulating unit 22' of connector 2', from one side to the other, to emerge on the front surface in the form of female contact elements 23'. The bent parts of contact elements 20', in the form of pins, are designed to be inserted into metal plated openings 10' of a printed circuit board 1'.

As previously noted, insulating unit 22' of connector 2' is provided with pins 21' on its base, pins designed to be inserted into openings 11' on printed circuit board 1'.

Connector 2' is designed to be coupled to connector 2, of FIG. 1, the insulating units of the connectors also being provided with additional correction elements: grooves 24 (connector 2) and slides 24' (connector 2') .

Numerous connector configurations, male or female, can be derived from the configurations of FIGS. 1 or 2, described by way of example.

Figure 3:
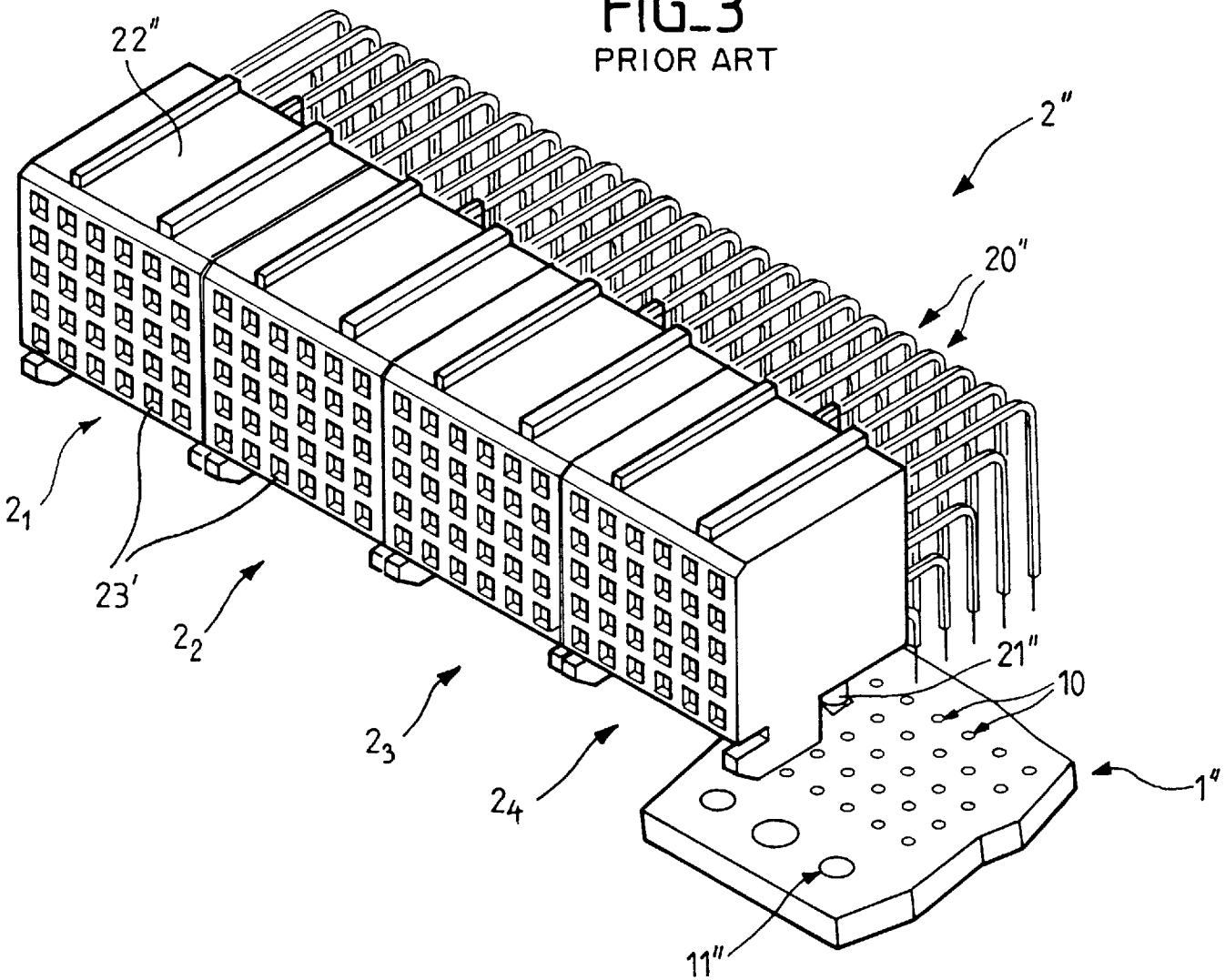
FIG 3 PRIOR ART
FIG. 3 illustrates a variant of the connector according to FIG. 2.

For a given type, all of these connectors can be made from a base module. FIG. 3 illustrates an example of connector 2" repeating four times the base module that makes up connector 2' of FIG. 2, or the sub-assemblies $2_1$ to $2_4$.

The total length of insulating unit 22" of connector 2" is equal to a whole number of the lengths of connector 2'. As previously noted, the bent parts of contact elements 20" (pins) are inserted into metal-plated openings 10" of a printed circuit board 1". Base 22" of connector 2" also has pins 21" designed to be inserted into openings 11" made in printed circuit board 1".

The different sub-assemblies $2_1$ to $2_4$ are not, in reality, separate. Insulating unit 22" is of one piece. The bond between each sub-assembly is realized by the material comprising insulating unit 22", in general, a plastic.

The arrangements adopted, while they conserve modularity well, nevertheless have a disadvantage. In fact, for each connector module of a given type, it is necessary either to have available different molds (as many as the connector lengths) or to proceed to operations of soldering the different modules together, for example, by ultrasound. In this latter case, it is necessary to have available cumbersome machines and to carry out relatively complex operations.

Moreover, in shielded versions (not shown), it is necessary to realize the necessary shieldings, also for different connector lengths.

The invention, while having the different advantageous aspects of connectors of the prior art, for which several examples of configuration have just been mentioned, will permit alleviating these disadvantages.

According to a first important characteristic of the invention, for a given type, the connectors of a range (i.e., the different modules of this range) are all produced from the repetition of a base module. However, the units of the different modules remain physically independent from one another.

According to a second important characteristic, shielding is realized by sheet metal in the form of a continuous strip. Cut to the desired length (i.e., a whole multiple of the length of a base module), the latter serves to assemble and fasten the different base modules comprising the connector. FIG. 4 illustrates, in lateral section, a first example of the embodiment of connector 4 according to the invention. The latter is similar, regardless of the shape, to the connector shown in FIG. 1 and takes on its principal characteristics.

Insulating unit 42 of connector 4, in the shape of a "U", comprises two vertical lateral wings, left 42*g* and right 42*d*, and a horizontal base 42*f*. The rectilinear contact elements 40, forming male contacts inside the open chamber that forms the "U", pass through base 42*f*. For each side of insulating unit 42 of connector 4 a shielding element is positioned, 5*g* and 5*d* respectively, a shielding element whose characteristics will be specified in discussing FIGS. 5*a* to 5*c*.

Lateral wings 42*g* and 42*d* comprise a certain number of openings and slots, such as openings 420*g* and 420*d* and slots 421*g* and 421*d*, visible in FIG. 4. Shielding elements 5*g* and 5*d* have tabs forced into these slots: 50*g* and 51*g* and 50*d* and 51*d*, respectively. They also comprise tabs 52*d* or 52*g*, which have the function of assuring the electrical continuity between shielding elements, 5*g* and 5*d,* on the one hand, and the shielding elements of a connector of a complementary type, which will be described in discussing FIGS. 7 to 8*b.*

Figures 5A, 5B, 5C:
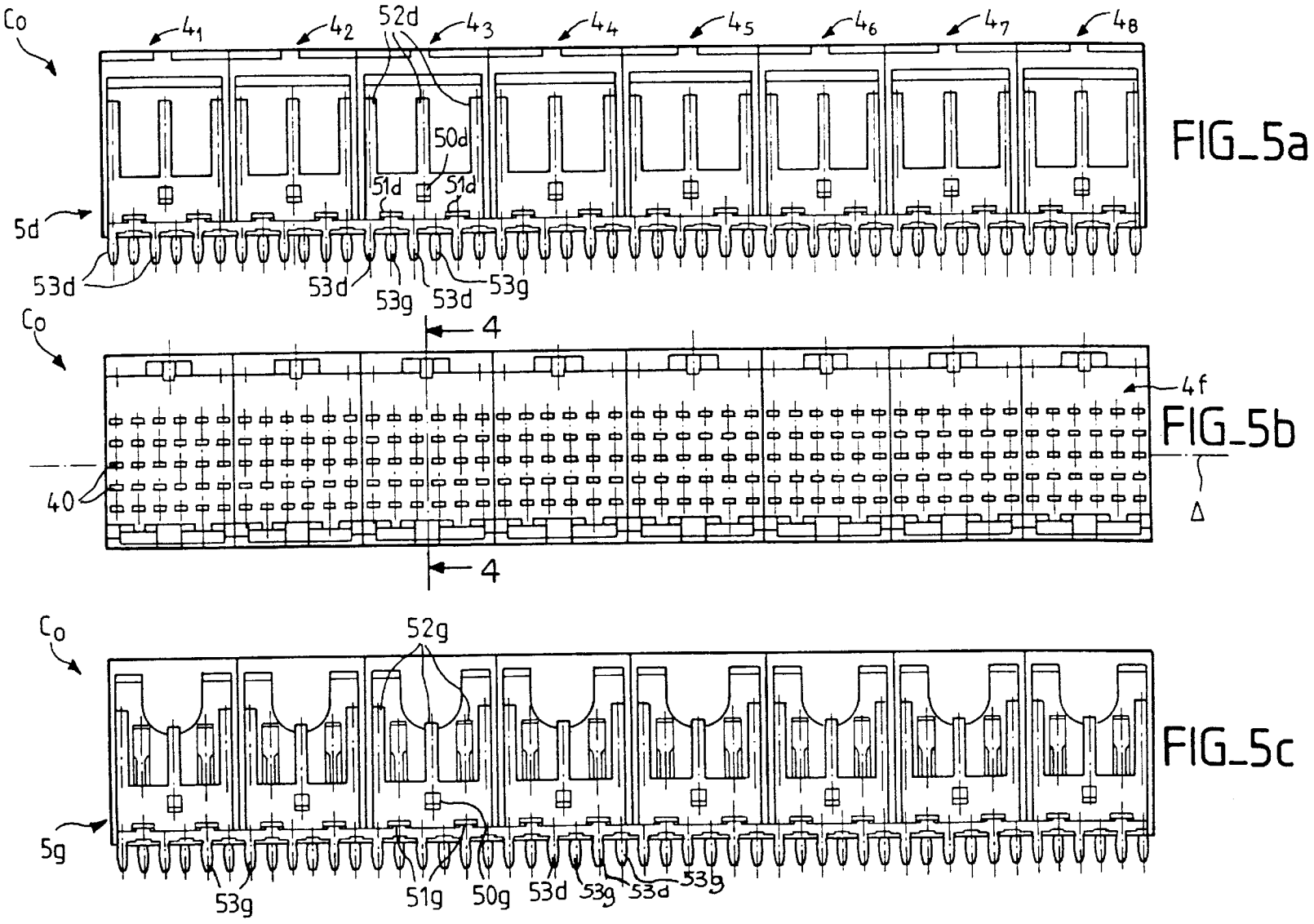
FIGS. 5*a* to 5*c* illustrate this same connector, respectively viewed from the right, the bottom and the left.

FIGS. 5*a,* 5*b* and 5*c* illustrate a complete connector $C_{602}$ made from several elementary connectors 4, respectively, in right, bottom and left views. The connector illustrated in these figures happens to have eight elementary connectors, or base modules, referenced $4_1$ to $4_8$. All these modules are physically independent from one another. They are positioned adjacent to one another, along a longitudinal axis Δ. They are assembled and held together, precisely, by means of shielding elements, 5*g* and 5*d.*

According to an important characteristic of the invention, which has been mentioned, the modules repeat all along connector $C_{602}$. It is therefore sufficient to realize one repetitive cut, for a given type of connector, in a metal strip whose physical characteristics, thickness, width, electrical and magnetic properties, are predetermined as a function of a given application.

For a given connector model comprising N modules 4 (with N a whole number ≧1 ), it is then sufficient to precut the abovementioned strip so that each section has N elementary units. In a more precise manner, since the design of each [left or right ] shielding element, 5*d* and 5*g,* respectively, is a priori different, it will be necessary to have available two shielding strips for each connector model.

The holding together of the different modules is realized easily according to the invention. In fact, it is sufficient to effect a simple pushing operation to force the abovementioned tabs of shielding elements 5 *g* and 5*d* into their respective housings so that all the base modules (eight in the example) are joined together in one piece.

Moreover, other than the primary role of magnetic shielding and that of fastening, which has just been described, shielding elements 5*d* and 5*g* can play other roles.

If one refers again to FIG. 4, it is observed that, in the example described, upper tabs, 52*d* and 52*g,* respectively, are forced inside the chamber of connector 4. The latter is designed to receive a connector of the complementary type. Tabs 52*d* and 52*g* assure electrical continuity.

FIG. 6 illustrates the configuration of metal-plated openings positioned on a printed circuit board 6 designed to receive connector $C_{602}$.

In reality, two types of metal plated holes are provided a first type has regular spacing or principal grid 60 in the form of a matrix with five lines and forty-eight columns in the example illustrated. In fact, each module 4 has 5 ×6 contact elements inserted in printed circuit board 6, arranged in matrix form. Spacing p usually conforms to standards or practical norms, depending on the application envisioned.

Two rows of metal-plated openings, 61 and 62, are also provided, each row being able to receive the vertical tabs, 53*d* or 53*g* respectively, of shielding elements 5*d* and 5*g.* These openings permit the attachment of the shielding to printed circuit 6, for example, by soldering or forced insertion of tabs 53*d* and 53*g.* Advantageously, metal-plated openings 61 and 62 are in galvanic contact with a ground region (not shown) of printed circuit 6.

In an advantageous manner, these metal-plated openings are arranged according to a grid merged with the principal grid of metal-plated openings 60. However, in the example described, there is only one opening in two. In other words, the repetition spacing p' is a submultiple of spacing p, in this case p'=p/2 .

Moreover, according to a preferred mode of embodiment, openings 62 of the upper row (in the figure) are alternated with those 61 of the lower row. Finally, still in the example described, the principal grid of metal-plated openings 60 is not positioned symmetrically with regard to a longitudinal axis 42, forming the axis of symmetry for contact elements 40. As a result, the vertical tabs also assure a correction function during the mounting of connector $C_{602}$ on printed circuit 6.

FIG. 7 illustrates, in lateral section, a second example of embodiment of connector 7, according to the invention. The connector represented is of a type complementary to connector 4 (FIG. 4). In this case, it is a male connector. The configuration of the latter is similar, regardless of the form, to that of connector 2'(FIG. 2) and it takes on its principal characteristics.

Insulating unit 72, the solid main part, encloses a set of contact elements 70, bent to approximately 90° as in the case of previously described connector 2'. Contact elements 70 emerge on the bottom surface 72*f* so as to be able to be inserted into the metal-plated openings of a printed circuit plate (not shown). These contact elements are extended, on front surface 72 av, by female contact elements 70'. On the front surface, an opening matrix 73 is provided, advantageously flared, so as to facilitate the insertion of the male contact elements of a complementary connector (not shown) into female contact elements 70'. One or more positioning pins 71 are also provided on the bottom surface. Finally, slides 24'are also provided.

Connector 7 is provided with shielding elements 8*b* and 8*a,* respectively, on one part of bottom surface 72*f* and on the top surface 72*d* and rear surface 72*ar.* Ground connection pins 74 can also be provided connecting to bottom shielding element 8*b.*

Figure 8A:
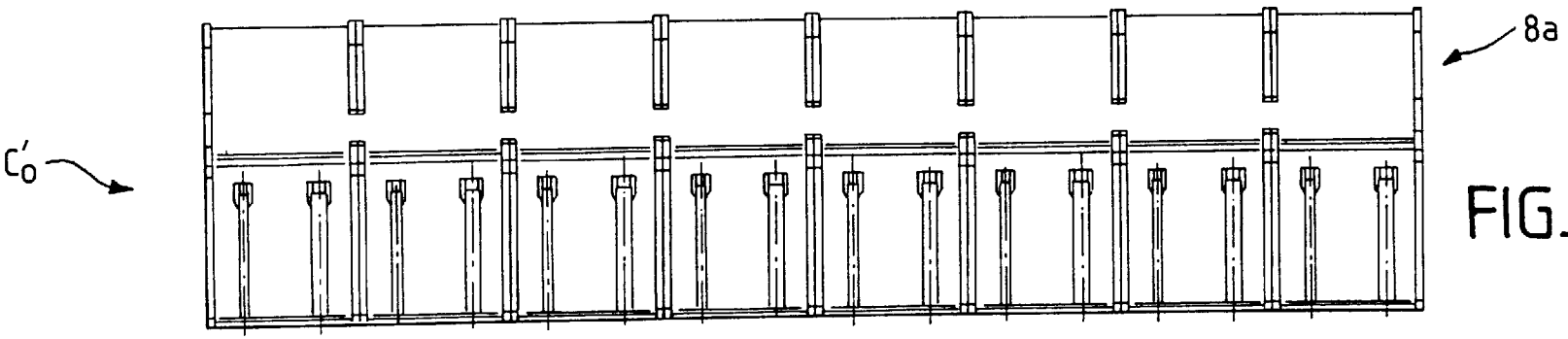
FIGS. 8*a* and 8*b* illustrate this same connector, respectively viewed from the top and the rear.
Figure 8B:
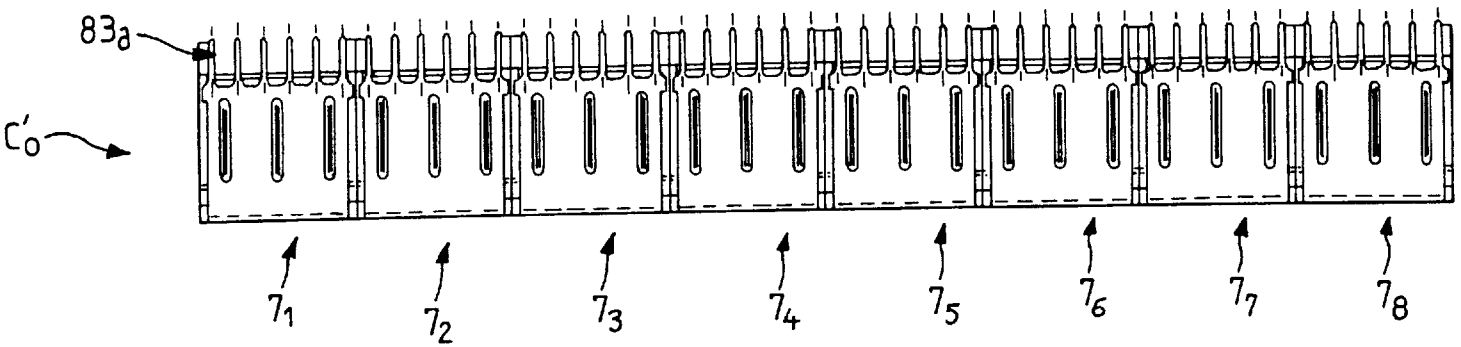

As previously, modules $7_1$ to $7_8$ composing a complete connector $C_{602}$' such as shown in FIGS. 8*a* and 8*b,* are physically independent from one another. More precisely, FIG. 8*a* shows connector $C_{602}$' viewed from rear surface 72*d* and FIG. 8*b* shows connector $C_{602}$' viewed from rear surface 72*ar.*

Also as previously, and according to one important characteristic of the invention, there are shielding elements 8*a* and 8*b* that assure the functions of assembly and holding the modules together.

If one again refers to FIG. 7, it is observed that the insulating unit of each elementary connector or base module 7 comprises openings or slots, some of which have been shown: 720. Shielding elements 8*a* and 8*b* comprise tabs or tongues, for example, 80*a,* which will be pushed inside housings provided for this purpose. More particularly, in the case of male type connectors, as shown in the figure, it is on slides 24' that the shielding 8*a* will be attached, as is shown more particularly in detail FIG. 7*a.* In this way, as previously, the different modules $7_1$ to $7_8$ will be connected together in one piece.

Figure 9:
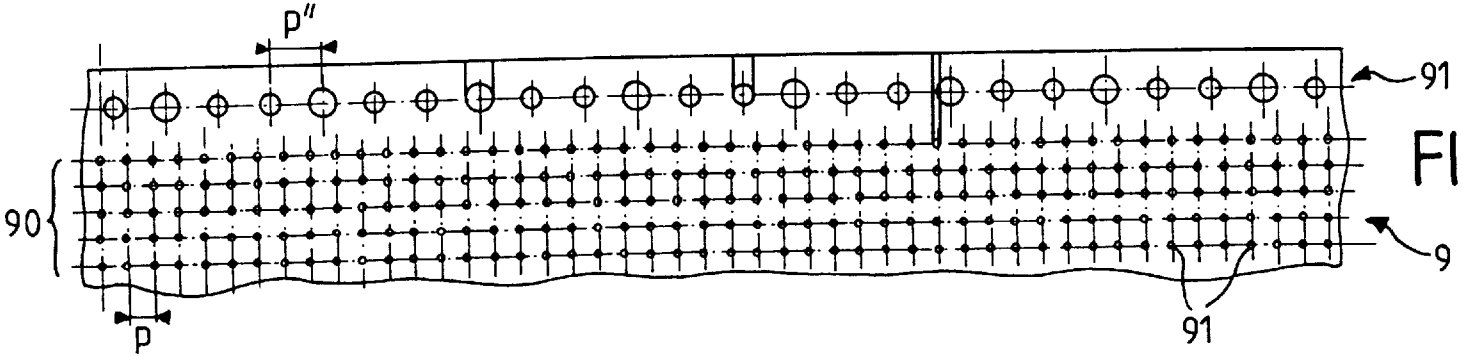
FIG. 9 illustrates a printed circuit board able to receive this connector.

FIG. 9 illustrates a fragment of printed circuit plate 9 comprising metal-plated openings. A first grid of metal-plated openings 90, of spacing p, is designed to receive contact elements 70. The latter are then soldered.

Due to the particular configuration of connector $C_{620'}$, only shielding element 8*a* has tabs 83*a* playing a role similar to tabs 53*d* and 53*g* of connector 4 (FIGS. 4, 5*a* and 5*c.* ) These tabs can be inserted into a first row of metal-plated openings 91 with the same spacing as the grid of metal-plated openings 90. This row of metal-plated openings is advantageously in galvanic contact with a ground track. Tabs 83*a* are advantageously attached to printed circuit 9 by soldering or forced insertion into metal-plated openings 91.

A row of openings 91 is also provided in which are inserted pins 71 and 74 (FIG. 7). These openings are usually of a greater diameter than metal-plated openings 90–91 and of a greater diameter.

Due to the particular configuration of connector $C_{620'}$, it is necessary to effect, during manufacture, a supplementary operation of bending shielding element 8*a* to about 90°along a longitudinal axis so as to cover surfaces 72*ar* and 72*d* of insulating unit 72 of connector 7.

In contrast, shielding elements 8*a* and 8*b* can be made, as previously, from sheet metal strips having a repetitive cut, at equal spacing to that of base module 7.

In the light of the previous description, it is easily observed that the invention has clearly achieved its objectives.

The connectors are extremely modular since, for a given range of connectors, it is only necessary to have available a single type of elementary connector or base module and therefore a single mold.

On the other hand, the manufacturing operations are simplified. It is sufficient to have available, at most, two shieldings [left and right] with a repetitive configuration for the spacing of the previously described module and to cut it into length segments that are multiples of this module. The necessary cuts can be produced by stamping.

The assembly operations are not significantly complex. Only a single pushing of the strip into the housings of the insulating units of elementary connectors is necessary in the majority of cases. For certain connector configurations, such as that described in regard to FIG. 7, a simple supplemental bending operation is realized.

It must be clear, however, that the invention is not limited to only the examples and embodiments specifically described, notably in relation to FIGS. 4 to 9. As has been indicated, the configuration of elementary connectors or base modules is susceptible to numerous variations, without exceeding the scope of the invention. In itself, this aspect is, moreover, common to the prior art.

In the same way, the number of base modules constituting a connector is only limited by practical considerations. In a typical manner, it is comprised within a range of 1 to 10.

Finally, although two shielding elements usually are provided, as has been described, for certain configurations, only a single one may be provided, or in contrast, more than two (for example, on three surfaces, which may eliminate a bending operation). In addition, the configuration of the two bending elements can be identical, contrary to the example described in relation to FIGS. 4 and 5*a* to 5*c*.

Connection elements conforming to the invention notably permit realizing electrical contacts from a mother board and/or a daughter board, or even from a printed circuit board with a cable bundle.

What is claimed is:

1. Process for production of modular electrical connection element ($C_o$), characterized in that the process comprises a preliminary phase of providing an elementary connection element (4), constituting a base module, said elementary connection element (4) comprising an insulating unit with a shape (42) having a central region designed to receive electrical contact elements (40) and having slots (421*d*, 421*g*) in specific zones on an outer surface of the insulting unit (42), and an assembly phase of assembling a predetermined number N of the elementary modules ($4_1$ to $4_8$), where N is a whole number greater than or equal to unity, the assembly phase comprising at least the following steps:

providing at least one shielding element (5*d*, 5*g*) from sheet metal, designed to cover said specific zones, each shielding element having a repetitive configuration of elementary length equal to that of said elementary connection element (4), placing N elementary connection elements ($4_1$ to $4_8$) along a given axis so as to form said connection element ($C_o$), and covering said specific zones by placing the at least one shielding element (5*d*, 5*g*) on and fastening of these) the N elementary connection elements ($4_{1-8}$) and fastening the shielding element to the elementary connection elements by pushing specific zones (50*d*–51*d*, 50*g*–50*d*) of each of said shielding elements (5*d*, 5*g*) into said slots (421*d*, 421*g*), wherein the shielding element mechanically connects the elementary connection elements to each other to form a unitary structure which is connectable to an electronic component as a single unit.

2. Process according to claim 1, further characterized in that, said insulating unit (42) of said elementary connection element (4) has a shape of a "U",and said covering step comprises placement of the at least one shielding element (5*d*, 5*g*) on outer surfaces of two wings (42*d*, 42*g*) of the "U".

3. Process according to claim 1, further characterized in that said shielding elements (5*d*, 5*g* 8*a*, 8*b*) are provided by stamping from continuous sheet metal strips.

4. Process according to claim 3, further characterized in that the step of providing said shielding elements (5*d*, 5*g* , 8*a*) comprises providing tabs (53*d*, 53*g*, 83*a*) along one side of said strips, according to a given spacing, and in that the tabs are designed to be inserted into metal-plated openings (61, 62, 91) of a printed circuit board (6, 9).

5. Process of production of a modular electrical connection element ($C_o$), characterized in that the process comprises a preliminary phase of providing an elementary connection element (4), constituting a base module, said elementary connection element (7) comprising an insulating unit with a shape (72) having a central region designed to receive electrical contact elements (70), slides (24') on at least one surface of the insulating unit and slots (720) in specific zones of an outer surface of the insulating unit (72), and an assembly phase for assembling a predetermined number N of the elementary modules ($7_1$ to $7_8$), with N a whole number greater than or equal to unity, the assembly phase comprising at least the following steps:

providing at least one shielding element (8*a*, 8*b*), from each sheet metal, designed to cover said specific zones, each shielding element having a repetitive configuration of elementary length equal to a length of said elementary connection element (7), placing N elementary connection elements ($7_1$ to $7_8$) along a given axis, so as to form said connection element ($C_o$), covering said specific zones by placing at least one shielding element (8*a*, 8*b*) on the N elementary connection elements ($7_1$ to $7_8$) and the shielding element fixedly attaching the elementary connection elements to each other by pushing of specific zones (80*a*) of each of said shielding elements (8*a*, 8*b*) into said slots (720) and fitting of at least one of said shielding elements (8*a*) onto said slides (24'), wherein the shielding element mechanically connects the elementary connection elements to each other to form a unitary structure which is connectable to an electronic component as a single unit.

6. Process according to claim 5, further characterized in that, said insulating unit (72) of said elementary connection element (7) has a roughly parallelpiped rectangle shape having four walls along a longitudinal axis Δ, said contact elements (70) being sent at about 90° inside said insulating unit (72), said contact elements (70) emerge in the form of rectilinear pins in a zone covering a part of a first wall (72*f*) of said insulating unit (72) and abut against a surface of a second wall (72av), orthogonal to the first, in the form of female contact elements (70'), said covering step comprising placing a first shielding element (8*b*) on part of the first surface (72*f*) not covered by said rectilinear pins (70) and of a second shielding element (8*a*) on the third (72ar) and fourth walls (72*d*).

7. Process according to claim 6, further characterized in that the process comprises an additional steps of bending of said second shielding element (8*a*) about 90° along said longitudinal axis (Δ).

* * * * *

UNITED STATES PATENT AND TRADEMARK OFFICE

CERTIFICATE OF CORRECTION

PATENT NO. : 5,857,265

DATED : Jan. 12, 1999

INVENTOR(S) : Etiembre et al.

It is certified that error appears in the above-identified patent and that said Letters Patent is hereby corrected as shown below:

In column 8, line 10, delete [and fastening of these]
line 11, insert --4-- before the "8"

In column 8, line 27, add a comma after --5g-- ;

In column 10, line 6, delete "steps" and insert --step--.

Signed and Sealed this

Twenty-fifth Day of May, 1999

*Attest:*

Q. TODD DICKINSON

*Attesting Officer*

*Acting Commissioner of Patents and Trademarks*